US005464218A

United States Patent [19]

Schmidt et al.

[11] Patent Number: 5,464,218

[45] Date of Patent: * Nov. 7, 1995

[54] GOLF PUTTER HEAD WITH UNDERCUT BACK CAVITY AND PERIPHERAL WEIGHTING

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Feb. 1, 2011, has been disclaimed.

[21] Appl. No.: 267,885

[22] Filed: Jul. 7, 1994

[51] Int. Cl.[6] ..... H63B 53/04

[52] U.S. Cl. ..... 273/169; 273/167 A; 273/167 H; 273/167 F

[56] References Cited

U.S. PATENT DOCUMENTS

| | | |
|---|---|---|
| D. 162,054 | 2/1951 | Markovich . |
| D. 196,734 | 10/1963 | Solheim . |
| D. 223,767 | 6/1972 | Houghtaling . |
| D. 228,355 | 9/1973 | Penn . |
| D. 234,209 | 1/1975 | Bizovi . |
| D. 234,963 | 4/1975 | Hirata . |
| D. 238,285 | 12/1975 | Ross . |
| D. 245,441 | 8/1977 | Middlestadt . |
| D. 246,541 | 11/1977 | Myers . |
| D. 247,383 | 2/1978 | Adkins . |
| D. 248,181 | 6/1978 | Cervantes . |
| D. 248,783 | 8/1978 | Long . |
| D. 257,784 | 1/1981 | Forys et al. . |
| D. 285,956 | 9/1986 | Shearer . |
| D. 303,132 | 9/1989 | Muta . |
| D. 320,427 | 10/1991 | Antonious . |
| D. 321,920 | 11/1991 | Parente et al. . |
| D. 334,606 | 4/1993 | Cameron . |
| 922,444 | 5/1909 | Youds . |
| 1,485,685 | 3/1924 | McMahon . |
| 1,511,479 | 10/1924 | Kelly et al. . |
| 1,517,476 | 12/1924 | Tyler . |
| 1,678,637 | 7/1928 | Drevitson . |
| 1,854,548 | 4/1932 | Hunt . |
| 1,894,706 | 1/1933 | Reach . |
| 1,894,707 | 1/1933 | Reach . |
| 1,906,239 | 5/1933 | Reach . |
| 1,946,007 | 2/1934 | Watson . |
| 1,953,604 | 4/1934 | Heller . |
| 1,980,408 | 11/1934 | Janksy . |
| 1,993,928 | 3/1935 | Glover . |
| 2,129,068 | 9/1938 | Reach . |
| 2,231,847 | 2/1941 | Dickson et al. . |
| 2,661,952 | 12/1953 | Jackson . |

(List continued on next page.)

FOREIGN PATENT DOCUMENTS

| | | |
|---|---|---|
| 901416 | 4/1985 | Belgium . |
| 2575393 | 7/1986 | France . |
| 2680695 | 9/1993 | France . |
| 53-15412 | 5/1978 | Japan . |
| 37178 | 1/1991 | Japan . |
| 371974 | 5/1932 | United Kingdom . |

OTHER PUBLICATIONS

"Some of Our Best Friends are Hookers and Pushers", Golf World, Jan. 1974, p. 45.

"The Ounce That Counts", Golf World, Jan. 24, 1975, pp. 46 & 47.

"Stroke–Savers", Golf Digest, Mar. 1988, pp. 82–83.

"The Wilson Staff Dynapower Iron", Time, Mar. 24, 1967, p. 1.

PCT International Publication WO 85/01220 dated Mar. 28, 1985.

*Primary Examiner*—Sebastiano Passaniti

*Attorney, Agent, or Firm*—William W. Haefliger

[57] ABSTRACT

In a putter head, the combination including a longitudinally elongated putter body in the form of a bar having a forward face for striking a golf ball, and rear side, top and bottom walls, a toe and a heel, between peripherally weighted toe and heel regions; a main recess sunk forwardly in the rear side; and an undercut recess extending outwardly from the inner extent of the main recess whereby a reduced thickness plate is formed between the recesses and the front face.

27 Claims, 4 Drawing Sheets

U.S. PATENT DOCUMENTS

| | | |
|---|---|---|
| 2,781,197 | 2/1957 | Wiley . |
| 2,846,228 | 8/1958 | Reach . |
| 3,043,596 | 7/1962 | Ehmke . |
| 3,068,011 | 12/1962 | Sano . |
| 3,134,596 | 5/1964 | Boznos . |
| 3,199,872 | 8/1965 | Taylor . |
| 3,211,455 | 10/1965 | Hyden . |
| 3,218,072 | 11/1965 | Burr . |
| 3,240,497 | 3/1966 | Taylor . |
| 3,333,854 | 8/1967 | White . |
| 3,387,844 | 6/1968 | Shippee . |
| 3,680,868 | 8/1972 | Jacob . |
| 3,815,910 | 6/1974 | Raines . |
| 3,843,122 | 10/1974 | Florian . |
| 3,847,399 | 11/1974 | Raymont . |
| 3,863,932 | 2/1975 | Lezatte . |
| 3,888,492 | 6/1975 | Cabot . |
| 3,989,248 | 11/1976 | Campau . |
| 4,000,902 | 1/1977 | Perkins . |
| 4,121,832 | 10/1977 | Ebbing . |
| 4,199,144 | 4/1980 | Skelly . |
| 4,252,262 | 2/1981 | Igarashi . |
| 4,272,572 | 6/1981 | Netherly . |
| 4,330,128 | 5/1982 | Morelli . |
| 4,398,965 | 8/1983 | Campau . |
| 4,405,149 | 9/1983 | Piegay . |
| 4,420,156 | 12/1983 | Campau . |
| 4,438,946 | 3/1984 | Piegay . |
| 4,447,493 | 5/1984 | Driscoll et al. . |
| 4,484,746 | 11/1984 | Brill . |
| 4,498,672 | 2/1985 | Bulla . |
| 4,534,564 | 8/1985 | Yamada . |
| 4,632,400 | 12/1986 | Boone . |
| 4,653,756 | 3/1987 | Sato . |
| 4,655,459 | 4/1987 | Antonious . |
| 4,660,832 | 4/1987 | Shomo . |
| 4,679,792 | 7/1987 | Straza et al. . |
| 4,695,054 | 9/1987 | Tunstall . |
| 4,715,601 | 12/1987 | Lamanna . |
| 4,736,949 | 4/1988 | Muroi . |
| 4,740,345 | 4/1988 | Nagasaki et al. . |
| 4,792,139 | 12/1988 | Nagasaki et al. . |
| 4,798,383 | 1/1989 | Nagasaki et al. . |
| 4,811,950 | 3/1989 | Kobayashi . |
| 4,848,747 | 7/1989 | Fujimura et al. . |
| 4,854,581 | 8/1989 | Long . |
| 4,865,345 | 9/1989 | Piegay . |
| 4,869,507 | 9/1989 | Sahm . |
| 4,884,812 | 12/1989 | Nagasaki et al. . |
| 4,913,435 | 4/1990 | Kobayashi . |
| 4,928,972 | 5/1990 | Nakanishi et al. . |
| 4,957,294 | 9/1990 | Long . |
| 4,960,279 | 10/1990 | Harris, Jr. . |
| 4,964,640 | 10/1990 | Nakanishi et al. . |
| 4,986,541 | 1/1991 | Teramoto et al. . |
| 4,995,609 | 2/1991 | Parente et al. . |
| 4,995,630 | 2/1991 | Piegay . |
| 5,016,882 | 5/1991 | Fujimura et al. . |
| 5,026,056 | 6/1991 | McNally et al. . |
| 5,046,733 | 9/1991 | Antonious . |
| 5,060,949 | 10/1991 | Brill . |
| 5,067,711 | 11/1991 | Parente et al. . |
| 5,078,398 | 1/1992 | Reed et al. . |
| 5,082,279 | 1/1992 | Hull et al. . |
| 5,083,778 | 1/1992 | Douglass . |
| 5,118,562 | 6/1992 | Johnson et al. . |
| 5,154,425 | 10/1992 | Niskanen et al. . |
| 5,176,384 | 1/1993 | Sata et al. . |
| 5,193,805 | 3/1993 | Solheim . |
| 5,197,737 | 3/1993 | Desbiolles et al. . |
| 5,246,231 | 9/1993 | Antonious . |
| 5,248,145 | 9/1993 | Brown . |
| 5,277,423 | 1/1994 | Artus . |
| 5,282,625 | 2/1994 | Schmidt et al. . |
| 5,290,036 | 3/1994 | Fenton et al. . |
| 5,301,946 | 4/1994 | Schmidt et al. . |
| 5,332,223 | 7/1994 | Johnson . |
| 5,340,107 | 8/1994 | Baker et al. . |

GOLF PUTTER HEAD WITH UNDERCUT BACK CAVITY AND PERIPHERAL WEIGHTING

BACKGROUND OF THE INVENTION

This invention relates generally to the construction and configurations of golf putters, and particularly putter heads. It concerns substantial improvements which aid the golfer during alignment of the head relative to the golf ball, the putting green, and during initial placement of the head adjacent the ball, as well as during subsequent swinging of the club to stroke the ball toward the cup.

There is need for improvements in putter construction and configuration, which will assist the golfer in the manner referred to above. In particular, there is need for putters having improvements in peripheral weighting combined with enlarged sweet spots and which facilitate improved results, as disclosed herein.

SUMMARY OF THE INVENTION

It is a major object of the invention to provide an improved golf putter, and particularly a putter head incorporating unusual advantages in construction and mode of operation, as well as meeting the needs referenced above. Basically, the putter head comprises, in combination:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending outwardly from inner extent of the main recess whereby a reduced thickness plate is formed between the recesses and the front face.

As will appear, the undercut recess typically extends outwardly toward at least two of the following:

i) the top wall ii) the bottom wall iii) the toe iv) the heel; and it preferably is loop shaped and extends outwardly toward all four of the above i) through iv).

Accordingly, the sweet spot area of the thin front wall is substantially enlarged, and peripheral weighting is provided, particularly at the toe and heel of the head, for enhanced ball contact and stroking accuracy.

A further object is to provide bottom wall rearward projection, below the main recess in such manner as to lower the center of gravity of the head, for enhanced ball contact. In addition, the bottom wall defines a relatively large scoop located centrally of the bar between the head and toe, the scoop diverging toward the head rear side, and spaced rearwardly from its forward face. The large scoop is typically in the form of a bevel which intersects an outwardly convex elongated corner formed between the bottom wall and the rear side of the head. That rear side is typically angled downwardly and rearwardly, to provide a downwardly visible centered intersection of the main recess with said angled rear side. As a result the player can view the rearward extent of the main recess, as well as the elongated lowermost extent of the rear side of the head, for more accurately aligning the head with the ball, during putting.

A still further object comprises forming the body to have outwardly convex elongated corners between at least two of the following:

i) the top wall and forward face ii) the top wall and rear side iii) the bottom wall and forward face iv) the bottom wall and rear side. All four corners are typically made convex, and longitudinally parallel, as viewed downwardly by the golfer while tilting the head during ball address on the green, for enhanced alignment purposes as respects the head and the ball.

These and other objects and advantages of the invention, as well as the details of an illustrative embodiment, will be more fully understood from the following specification and drawings, in which:

DRAWING DESCRIPTION

DETAILED DESCRIPTION

Figure 1:
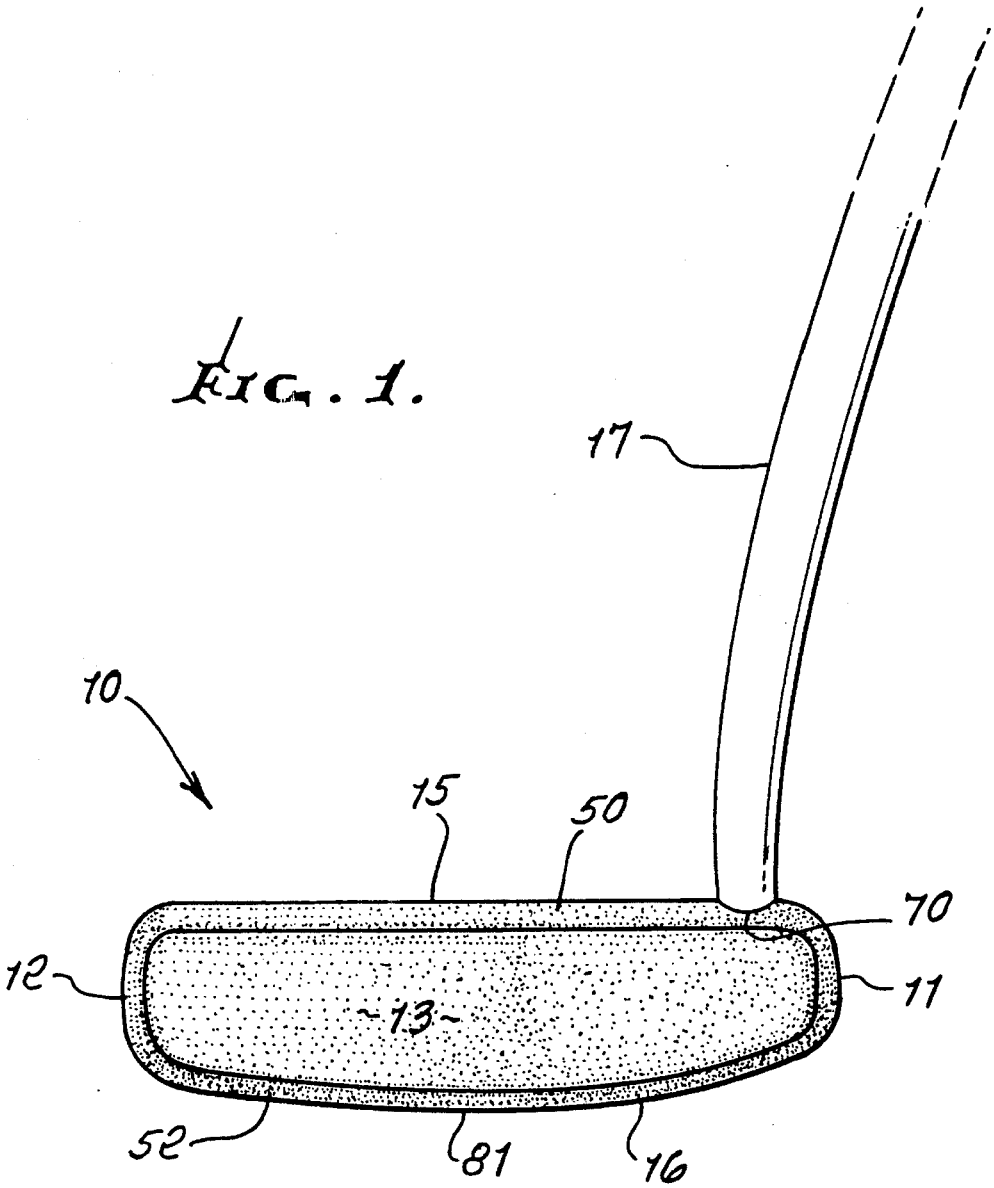
FIG. 1 is a front face view embodying our new putter head.

In the drawings, the putter head 10 has generally bar form, and may consist of metal, an example being brass. The head is longitudinally elongated between the heel 11 and toe 12, and has a golf ball striking front face 13, a concave rear side 14, a top wall or surface 15 and bottom wall or surface 16. See striations 80 extending in parallel relation on side 14. A putter shaft 17 extends upwardly from the top surface 15 near the heel, with curvature as shown, and typically, a bore 18 extends between the top and bottom surfaces 15 and 16 near the heel, and receives the lowermost portion of the shaft. The shaft may be adhered to the bore wall, as via an adhesive such as epoxy.

Figure 7:
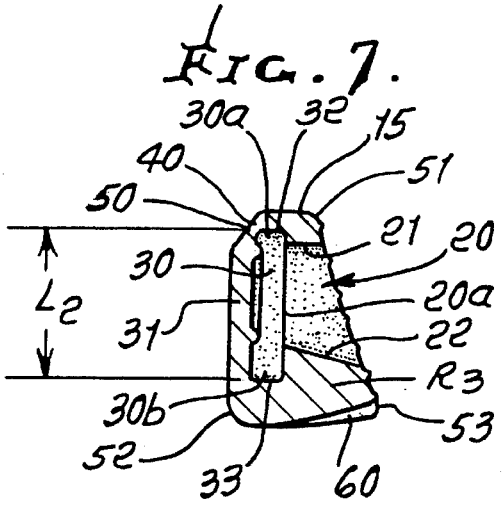
FIG. 7 is a sectional view taken on lines 7—7 of FIG. 6.
Figure 6:
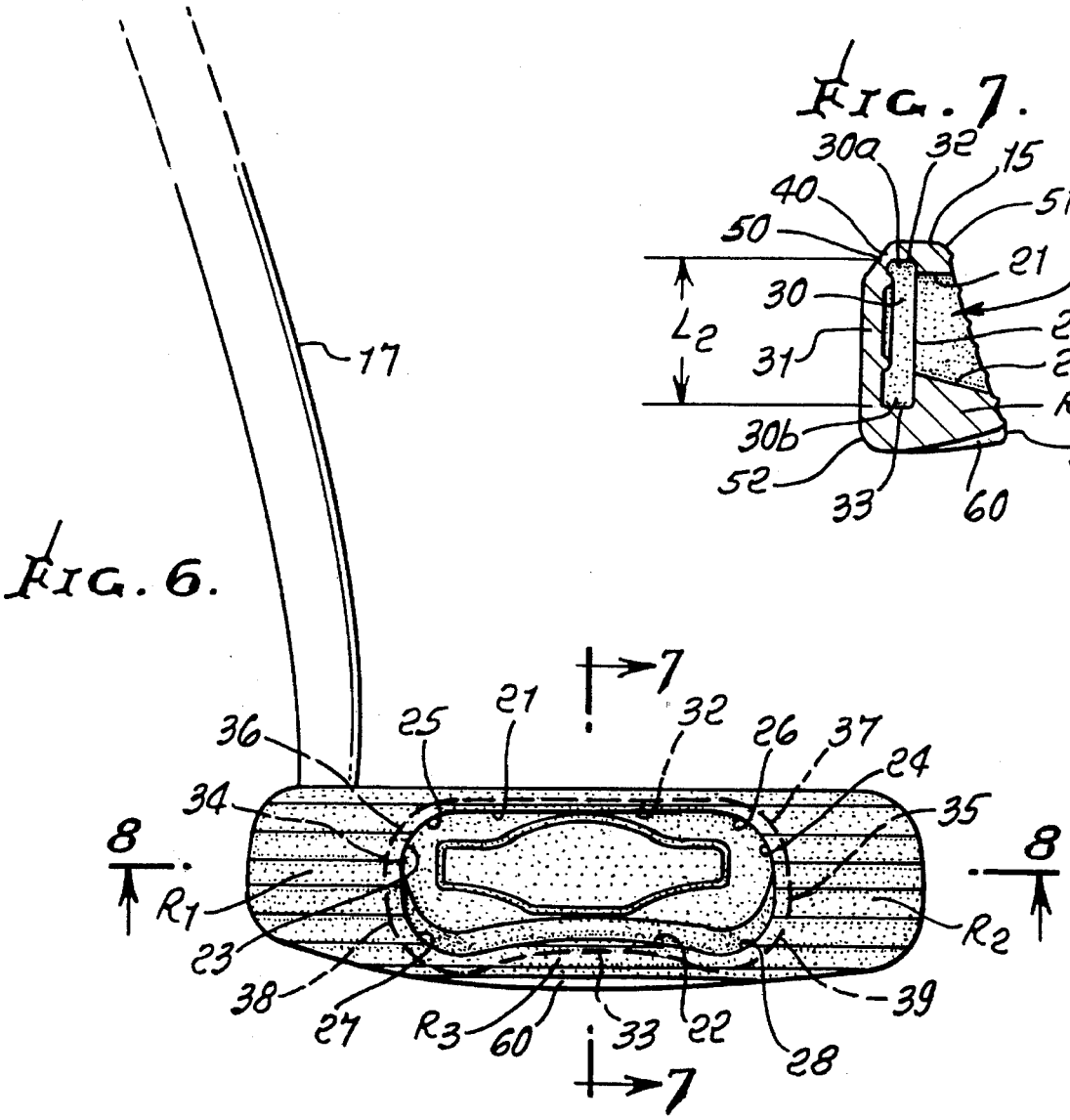
FIG. 6 is a rear view thereof.
Figure 8:
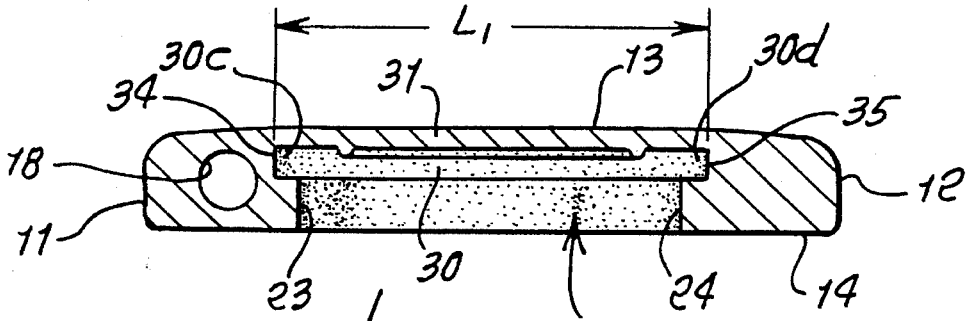
FIG. 8 is a sectional view taken on lines 8—8 of FIG. 6.

A main recess 20 is sunk in the head rear side 14 to extend forwardly, as for example is seen in FIGS. 6–8. Recess 20 has top and bottom walls 21 and 22, angled as shown, in FIG. 7, end walls 23 and 24, and concave corner walls 25–26 connecting the top wall 21 to end walls 23 and 24, and 27, 28 connecting bottom wall 22 with those end walls, as shown. The bottom wall is upwardly convex toward the recess 20, throughout the major extent of its length, recess 20 being longitudinally elongated as shown in FIG. 6.

An undercut recess 30 extends outwardly from the inner extent 20*a* of the main recess, whereby a reduced thickness ball striking plate 31 is formed between front face 13 and the recesses 20 and 30. The undercut recess 30 has a top elongated portion 30*a*, and a bottom elongated portion 30*b*, respectively extending outwardly toward top wall 15 and bottom wall 16. The undercut recess also has end portions 30*c* and 30*d* respectively extending outwardly (relative to the main recess) toward the heel 11 and toe 12. The recess 30 has elongated top and bottom walls 32 and 33, end walls 34 and 35, and concave interior corner walls 36–39 connecting top wall 32 to end walls 34 and 35, and connecting bottom wall 33 with those end walls, as shown. A web 40 is formed between 15 and 32, as seen in FIG. 7.

The looping undercut recess is effective to enlarge the area of the sweet spot effect provided by thin striking plate 31, as designated by plate length $L_1$ in FIG. 8, and plate height $L_2$ in FIG. 7. The head is thereby peripherally weighted in the regions $R_1$ and $R_2$ near the heel and toe, to resist twist of the shaft when the head strikes the golf ball during putting, especially when longer putts are required. Also, the center of gravity of the head is lowered by concentrating head mass in the longitudinally elongated lower region $R_3$ below the elongated recesses 20 and 30. Region $R_3$ is located to project rearwardly of undercut recess lower portion **30*b*, and also below the main recess 20, as is clear from FIG. 7. The vertical thickness of region $R_3$ is at a maximum at the center of the head, i.e. at the section of FIG. 7, and that thickness gradually reduces in directions from the center toward the toe and heel, as is clear from FIG. 6**. Therefore, weight is concentrated by region $R_3$ at the lowered center of gravity. Such lowering of the center of gravity, together with peripheral weighting at the toe and heel as referred to above, serve to minimize inaccuracies in ball directional control during putting that might arise when the ball is struck by a portion of the head spaced away from the center C of the striking face.

The head body forms outwardly convex or beveled elongated corners between at least two of the following:

i) the top wall and the forward face (see convex corner 50, in FIG. 7), ii) the top wall and the rear side (see elongated corner 51), iii) the bottom wall at the front face (see elongated corner 52), iv) the bottom wall and the rear side (see elongated corner 53).

Preferably three or all four such corners are provided, whereby corners 50, 51 and 53 assist the player in visually aligning the head normal to the plane of FIG. 7; and corner 52 also assists in the same manner when the head is tilted rearwardly during addressing of the ball, as well as assisting the head to slide or sled over the green turf during club swinging. Corners 50, 51 and 53 can be seen as the player looks downwardly at the head, corner 53 projecting rearwardly of corner 51 in upwardly projected view as seen by the golfer's eye, and they appear to provide three parallel lines, for enhanced alignment effect purposes. Note also downwardly visible parallel fluted edges 80' at the curved rear face of the head. See FIGS. 2, 6 and 7.

Figure 5:
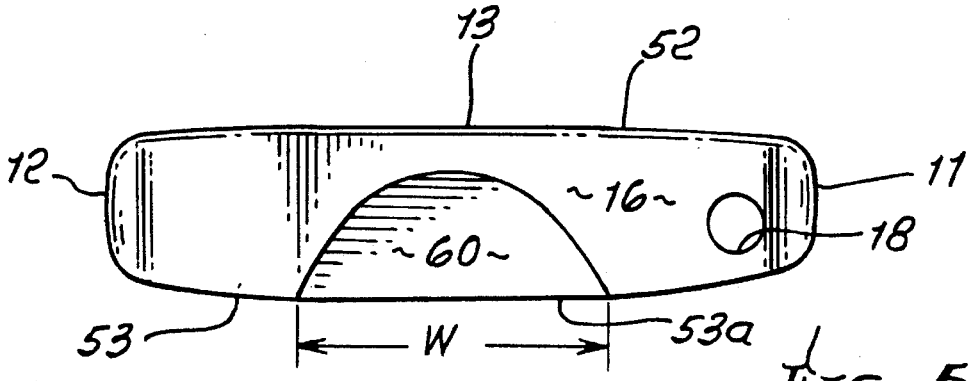
FIG. 5 is a bottom plan view thereof.

The eased sliding or sledding effect aided by corner 52, is also enhanced by provision of an enlarged "cut-out" or scoop 60, at the bottom center of the head, as seen in FIG. 5. That scoop centrally intersects elongated convex corner 53, as seen in FIGS. 6 and 7, and provides a shortened and sharper lower line **53*a* at the center of the head to enhance the visual zones to be aligned with the ball. The scoop or bevel also reduces the possibility of drag inducing engagement of the head bolt rear with the turf as the head moves forwardly immediately after impact with the ball. The width "W" of the scoop is between 60 and 80 percent of $L_1$, and its forward maximum dimension in FIG. 5 is at least ⅔ the overall forward to rearward dimension of bottom wall 16**.

Figure 2:
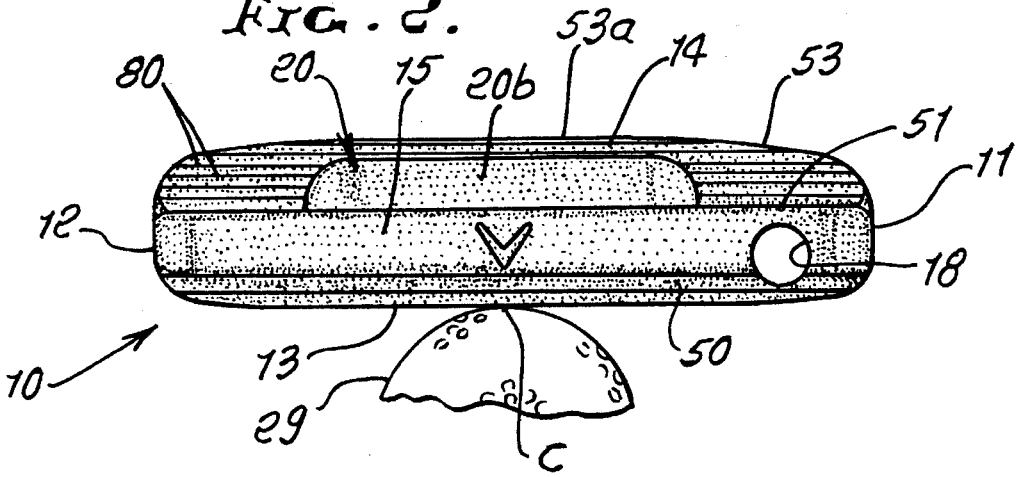
FIG. 2 is a top plan view thereof.
Figure 3:
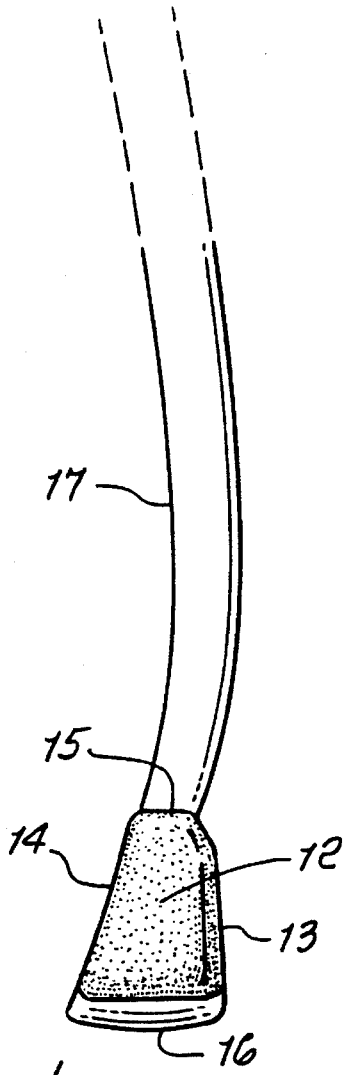
FIG. 3 is a toe end view thereof.
Figure 4:
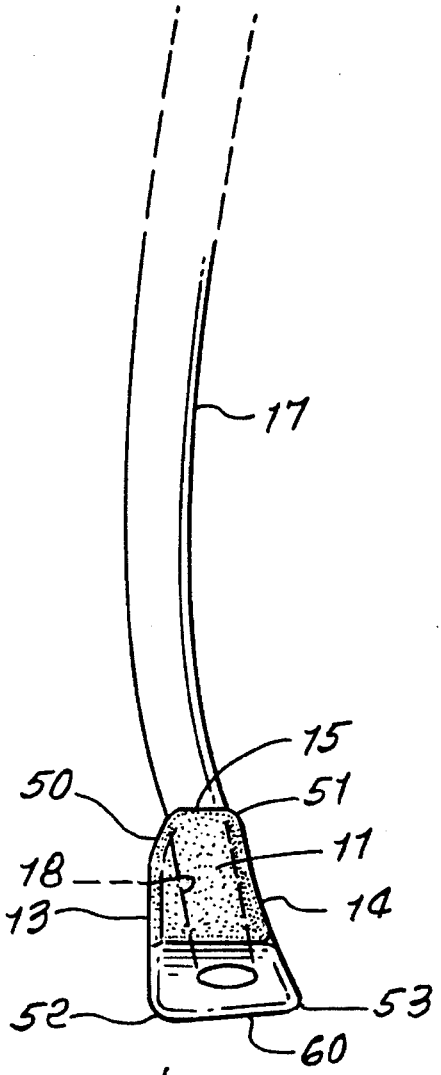
FIG. 4 is a heel end view thereof.

FIG. 2 shows the player's downward view of the rearward centered extent **20*b* of the main recess, during alignment with a golf ball 29. That rearward extent 20*b* intersects the downwardly and rearwardly slanting rear side of the head. Visibility of 20*b* also assists such centering alignment of the head with the golf ball. The bottom wall or sole 16 is downwardly shallowly convex between the toe and heel, as seen in FIG. 1, to minimize the chance of bottom wall engagement with the turf at locations spaced away from the bottom center 81 of the head, during the swing of the putter. The width "W" of the scoop is between 60 and 80 percent of $L_1$, and its forward maximum dimension in FIG. 5 is at least ⅔ the overall forward to rearward dimension of bottom wall 16**.

Figure 9:
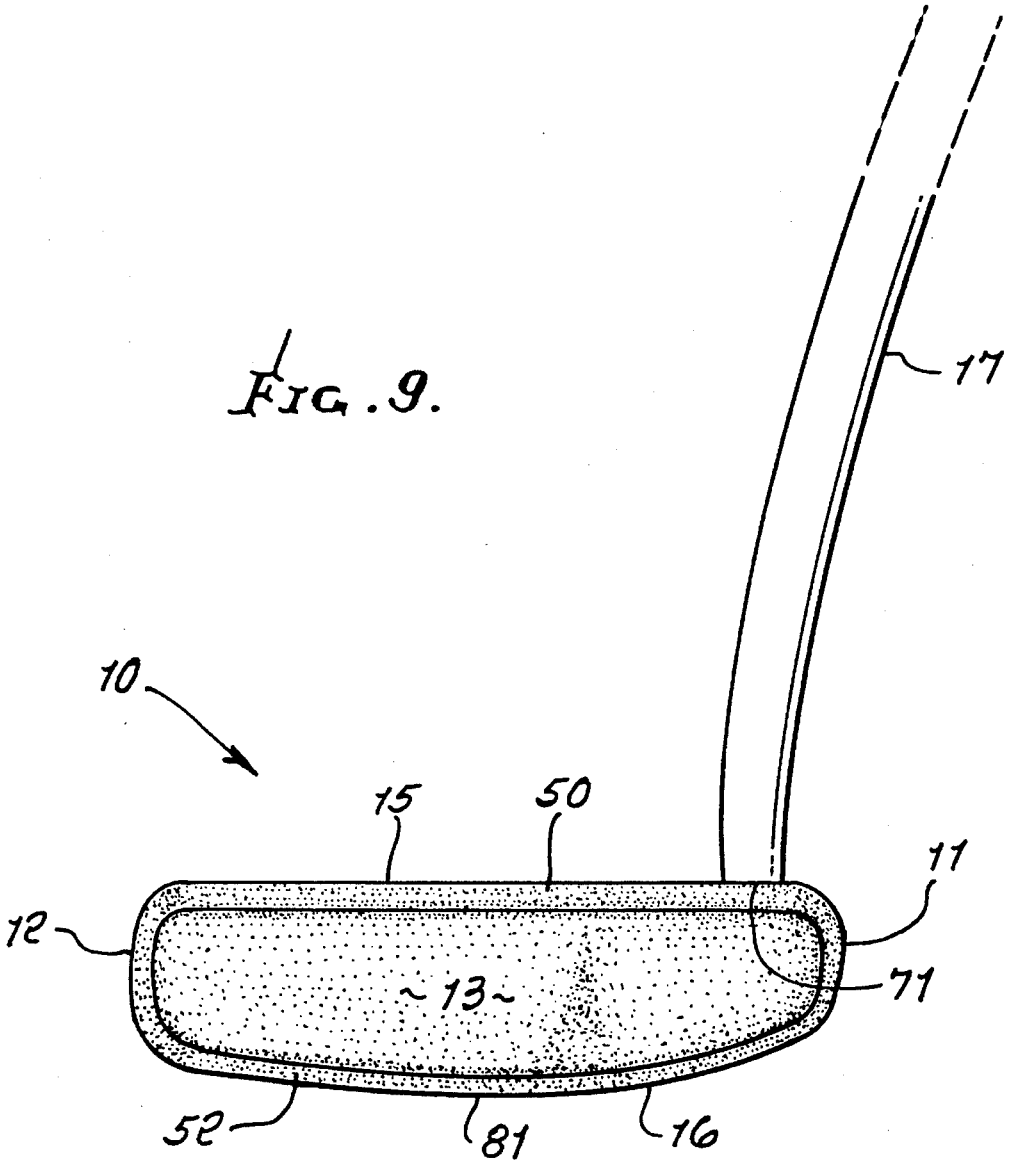
FIG. 9 is a view like FIG. 1 showing a modification.
Figure 10:
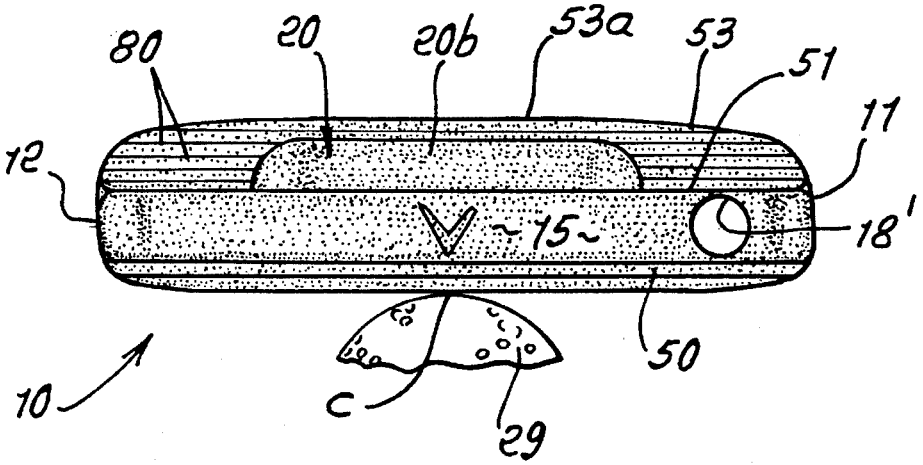
FIG. 10 is a top plan view of the head of FIG. 9.

In FIG. 2, the shaft receiving bore 18 has a top portion shown as intersecting flat top wall 15, and upper elongated bevel or convex corner 50, near heel 11. A scallop line is formed at 70 in FIG. 1, where bore 18 intersects bevel 50. In FIG. 9, the modified head is the same as the head shown in FIGS. 1–8, excepting that the shaft bore 18' is shifted to intersect only the flat top wall 15, as better seen in FIG. 10. Bore 18' is confined between the elongated convex corners 50 and 51; consequently the convex corner 50 is not interrupted by a scallop as at 70 in FIG. 1. See straight line 71 in FIG. 9.

We claim:

1. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending away from an inner extent of said main recess and in substantially parallel relation to said forward face whereby a reduced thickness plate is formed between said recesses and said forward face.

2. The combination of claim 1 wherein said undercut recess extends outwardly toward at least two of the following:

i) said top wall ii) said bottom wall iii) said toe iv) said heel.

3. The combination of claim 1 wherein said undercut recess extends outwardly toward at least three of the following:

i) said top wall ii) said bottom wall iii) said heel iv) said toe.

4. The combination of claim 1 wherein said undercut recess extends outwardly toward all four of the following:

i) said top wall ii) said bottom wall iii) said heel iv) said toe.

5. The combination of claim 1 wherein said body forms outwardly convex elongated corners between at least two of the following:

i) said top wall and said forward face ii) said top wall and said rear side iii) said bottom wall and said forward face iv) said bottom wall and said rear side.

6. The combination of claim 5 wherein said corners are formed between at least three of the following:

i) said top wall and said forward face ii) said top wall and said rear side iii) said bottom wall and said forward face iv) said bottom wall and said rear side.

7. The combination of claim 5 wherein said corners are formed between all four of the following:

i) said top wall and said forward face ii) said top wall and said rear side iii) said bottom wall and said forward face iv) said bottom wall and said rear side.

8. The combination of claim 6 wherein said elongated convex corners are substantially parallel with one another as viewed downwardly.

9. The combination of claim 7 wherein said elongated convex corners are substantially parallel with one another as viewed downwardly.

10. The combination of claim 5 wherein said bottom wall projects rearwardly to a greater extent than said top wall.

11. The combination of claim 5 wherein said elongated convex corners are parallel with one another.

12. The combination of claim 5 wherein a shaft bore extends downwardly in the head, and intersects said top wall and said elongated corner which is formed between said top wall and said forward face.

13. The combination of claim 1 wherein said bottom wall projects rearwardly to a greater extent than said top wall.

14. The combination of claim 1 wherein said bottom wall defines a scoop located centrally of the bar between the heel and toe, said scoop diverging toward said rear side, and spaced rearwardly from said forward face.

15. The combination of claim 14 wherein said scoop is in the form of a bevel.

16. The combination of claim 14 wherein said body forms an elongated outwardly convex corner between said bottom wall and said rear side, said scoop intersecting said convex corner.

17. The combination of claim 1 wherein a shaft bore extends downwardly in the head, from said top wall.

18. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending away from an inner extent of said main recess and in substantially parallel relation to said forward face whereby a reduced thickness plate is formed between said recesses and said forward face, and d) said bottom wall defining a bevel located centrally of the bar between the head and toe, said bevel diverging toward said rear side, and spaced rearwardly from said forward face.

19. The combination of claim 18 wherein said body forms an elongated outwardly convex corner between said bottom wall and said rear side, said bevel intersecting said convex corner.

20. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending away from an inner extent of said main recess and in substantially parallel relation to said forward face whereby a reduced thickness plate is formed between said recesses and said forward face, and d) there being a shaft bore that extends downwardly in the head, from said top wall.

21. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending away from an inner extent of said main recess and substantially parallel to said forward face whereby a reduce thickness plate is formed between said recesses and said forward face, d) and wherein a shaft bore extends downwardly in the head, and toward a region proximate an elongated corner formed between said top wall and said forward face.

22. The combination of claim 21 wherein said shaft bore intersects said top wall.

23. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and wherein said rear side is angled downwardly and rearwardly, to provide an upwardly projected visible intersection of the main recess with said angled rear side, d) there being an undercut recess extending away from the main recess and in substantially parallel relation to said forward face.

24. The combination of claim 23 including parallel edges on said angled rear side and extending in directions between the heel and toe.

25. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending away from an inner extent of said main recess and into said body rearwardly of said forward face whereby a reduced thickness plate is formed between said recesses and said forward face, and d) said body forming outwardly convex elongated corners between at least two of the following:

i) said top wall and said forward face ii) said top wall and said rear side iii) said bottom wall and said forward face iv) said bottom wall and said rear side.

26. In a putter head, the combination comprising:

a) a longitudinally elongated putter body in the form of a bar having a forward face for striking a golf ball, and rear side, top and bottom walls, a toe and a heel, b) a main recess sunk forwardly in said rear side, and between peripherally weighted toe and heel regions, c) and an undercut recess extending away from an inner extent of said main recess and into said body rearwardly of said forward face whereby a reduced thickness plate is formed between said recesses and said forward face, and d) said bottom wall projecting rearwardly to a greater extent than said top wall.

27. The combination of claim 5 wherein a shaft bore extends downwardly in the head, and intersecting said top wall between said elongated corners.

* * * * *